US006003179A

United States Patent [19]

Farley

[11] Patent Number: 6,003,179

[45] Date of Patent: Dec. 21, 1999

[54] INCLINED ANATOMIC SUPPORT SURFACE

[76] Inventor: David L. Farley, 18372 Evergreen Ave., Yorba Linda, Calif. 92686

[21] Appl. No.: 08/972,233

[22] Filed: Nov. 18, 1997

[51] Int. Cl.[6] ..... A47C 27/14; A61G 7/057

[52] U.S. Cl. ..... 5/736; 5/730

[58] Field of Search ..... 5/736, 740, 730; D6/595, 596

[56] References Cited

U.S. PATENT DOCUMENTS

| | | | |
|---|---|---|---|
| Re. 30,444 | 12/1980 | Spann | 5/650 |
| D. 174,812 | 5/1955 | Haller | 5/736 |
| D. 269,917 | 7/1983 | Spann | D32/51 |
| D. 287,641 | 1/1987 | Schaefer | 5/647 |
| D. 307,687 | 5/1990 | Raburn | D6/606 |
| D. 307,689 | 5/1990 | Schaefer | D6/606 |
| D. 307,690 | 5/1990 | Raburn | D6/606 |
| D. 311,108 | 10/1990 | Farley | 5/736 |
| D. 316,202 | 4/1991 | Farley | D6/596 |
| D. 322,907 | 1/1992 | Raburn | D6/596 |
| D. 326,204 | 5/1992 | Main | D6/596 |
| D. 326,976 | 6/1992 | Wickis, Jr. et al. | D6/601 |
| D. 339,019 | 9/1993 | Main | D6/595 |
| D. 339,261 | 9/1993 | Limon et al. | D6/596 |
| D. 352,858 | 11/1994 | Farley | D6/582 |
| D. 365,956 | 1/1996 | Bonaddio et al. | D6/596 |
| D. 366,175 | 1/1996 | Bonaddio et al. | D6/596 |
| D. 374,367 | 10/1996 | Bonaddio et al. | D6/596 |
| D. 381,543 | 7/1997 | Farley | D6/596 |
| D. 383,349 | 9/1997 | Steelman et al. | D6/595 |
| 988,117 | 3/1911 | Leonard . | |
| 1,334,901 | 3/1920 | Higdon | 5/81.1 X |
| 1,978,041 | 10/1934 | Dodge | 18/59 |
| 2,357,513 | 9/1944 | Harmon | 20/69 |
| 2,705,211 | 3/1955 | De Wyk, Jr. | 154/110 |
| 2,751,609 | 6/1956 | Oesterling et al. | 5/420 |
| 2,902,091 | 9/1959 | Dahle | 164/39 |
| 2,994,890 | 8/1961 | Wagner | 5/351 |
| 3,197,357 | 7/1965 | Schulpen | 161/116 |
| 3,243,828 | 4/1966 | McCarty | 5/338 |
| 3,311,007 | 3/1967 | McGee et al. | 83/1 |
| 3,431,802 | 3/1969 | Schulpen | 83/4 |
| 3,553,068 | 1/1971 | Coale | 161/125 |
| 3,639,927 | 2/1972 | Munch | 5/91 |
| 3,674,618 | 7/1972 | Spann | 161/64 |
| 3,682,739 | 8/1972 | Tesch et al. | 83/19 |
| 3,690,203 | 9/1972 | Huttemann | 83/1 |
| 3,695,128 | 10/1972 | Gentile | 83/1 |
| 3,730,031 | 5/1973 | Huttemann | 83/4 |
| 3,828,378 | 8/1974 | Flam | 5/730 |
| 3,903,878 | 9/1975 | Spann | 128/77 |
| 3,931,654 | 1/1976 | Spann | 5/327 |
| 3,938,205 | 2/1976 | Spann | 5/327 |
| 3,939,829 | 2/1976 | Spann | 128/133 |
| 3,946,451 | 3/1976 | Spann | 5/327 |
| 3,977,406 | 8/1976 | Roth | 128/296 |
| 4,042,987 | 8/1977 | Rogers | 5/345 |
| 4,070,719 | 1/1978 | Morgan | 5/481 |
| 4,108,170 | 8/1978 | Spann | 128/134 |
| 4,110,881 | 9/1978 | Thompson | 5/464 |
| 4,135,504 | 1/1979 | Spann | 128/80 |
| 4,185,813 | 1/1980 | Spann | 269/328 |
| 4,210,317 | 7/1980 | Spann et al. | 269/328 |
| 4,214,326 | 7/1980 | Spann | 5/431 |
| 4,233,700 | 11/1980 | Spann | 5/431 |
| 4,316,298 | 2/1982 | Russo et al. | 5/903 |
| 4,327,714 | 5/1982 | Spann | 128/80 |
| 4,335,476 | 6/1982 | Watkin | 5/464 |
| 4,351,211 | 9/1982 | Azzolini | 83/861 |
| 4,392,489 | 7/1983 | Wagner, Sr. | 128/80 |
| 4,418,514 | 12/1983 | Spann | 53/436 |
| 4,422,194 | 12/1983 | Viesturs et al. | 5/451 |
| 4,433,678 | 2/1984 | Spann | 128/80 |
| 4,471,952 | 9/1984 | Spann | 269/328 |
| 4,482,138 | 11/1984 | Spann | 269/328 |
| 4,522,447 | 6/1985 | Snyder et al. | 297/452 |
| 4,528,706 | 7/1985 | Branker | 5/465 |
| 4,550,547 | 11/1985 | Wagner, Sr. | 11/56 |
| 4,573,456 | 3/1986 | Spann | 128/80 |
| 4,598,701 | 7/1986 | Schaefer | 128/87 |
| 4,603,445 | 8/1986 | Spann | 5/481 |
| 4,620,337 | 11/1986 | Williams et al. | 5/736 |
| 4,672,700 | 6/1987 | Poncy | 5/653 |
| 4,673,452 | 6/1987 | Awdhan | 156/254 |
| 4,679,266 | 7/1987 | Kraft | 5/464 |
| 4,686,724 | 8/1987 | Bedford | 5/468 |
| 4,686,725 | 8/1987 | Mitchell | 5/481 |
| 4,700,447 | 10/1987 | Spann | 29/418 |
| 4,701,168 | 10/1987 | Gammons | 604/310 |
| 4,726,087 | 2/1988 | Schaefer et al. | 5/446 |
| 4,768,250 | 9/1988 | Kato et al. | 27/8 |
| 4,768,251 | 9/1988 | Baskent | 5/464 |

| | | | |
|---|---|---|---|
| 4,768,253 | 9/1988 | Boyd et al. | 5/464 |
| 4,832,007 | 5/1989 | Davis, Jr. et al. | 128/70 |
| 4,862,538 | 9/1989 | Spann et al. | 5/464 |
| 4,866,800 | 9/1989 | Bedford | 5/468 |
| 4,872,226 | 10/1989 | Lonardo | 5/61 |
| 4,879,776 | 11/1989 | Farley | 5/436 |
| 4,901,387 | 2/1990 | Luke | 5/464 |
| 4,955,096 | 9/1990 | Gilroy et al. | 5/464 |
| 4,972,535 | 11/1990 | Goldman | 5/464 |
| 4,999,868 | 3/1991 | Kraft | 5/464 |
| 5,007,124 | 4/1991 | Raburn et al. | 5/481 |
| 5,010,610 | 4/1991 | Ackley | 5/481 |
| 5,014,375 | 5/1991 | Coonrad et al. | 5/431 |
| 5,025,519 | 6/1991 | Spann et al. | 5/464 |
| 5,038,433 | 8/1991 | Farley | 5/464 |
| 5,077,849 | 1/1992 | Farley | 5/730 |
| 5,088,137 | 2/1992 | Rose | 5/626 |
| 5,111,542 | 5/1992 | Farley | 5/730 |
| 5,134,735 | 8/1992 | Rose | 5/464 |
| 5,172,439 | 12/1992 | Farley | 5/465 |
| 5,178,811 | 1/1993 | Farley | 264/138 |
| 5,604,021 | 2/1997 | Wagner | 5/736 |

FOREIGN PATENT DOCUMENTS

| | | |
|---|---|---|
| 6007253 | 12/1986 | European Pat. Off. . |
| 58-209534 | 12/1983 | Japan . |
| 242467 | 11/1925 | United Kingdom . |
| 687625 | 2/1953 | United Kingdom . |
| 903336 | 8/1962 | United Kingdom . |
| 1142494 | 2/1969 | United Kingdom . |
| 1559851 | 1/1980 | United Kingdom . |

OTHER PUBLICATIONS

"Floatation Unit With Speacial Protection Build Into The Torso Zone", by Bio Clinic Co., of 2 pages., Feb. 1985.

"The Cause Of Pressure Ulcers May Not Be This Obvious", by Geo–Matt, of 1 page.

"The Dermarest Therapeutic Comfort Mattress Program", by Derma Care Systems, of 2 pages.

"Introducing Geo–Matt", by Span–America, of 4 pages, 1986.

"IRIS 10,000, Iris Floatation System", by E.R. Carpenter Company, of 8 pages.

"How To Buy Quality Convoluted Foam Topper Pads", by Med Foam, of 1 page.

*Primary Examiner*—Alexander Grosz
*Attorney, Agent, or Firm*—Stetina Brunda Garred & Brucker

[57] ABSTRACT

A pad positionable upon an inclined surface for supporting a recumbent human being upon the inclined surface in a manner preventing slippage of the human being thereupon. The pad comprises a generally rectangularly substrate formed of a resilient material and having opposed lateral and longitudinal sides, a top surface, and a generally planar bottom surface. Formed within the top surface of the substrate are laterally extending shoulder, tail and foot support regions. Extending between the shoulder, tail and foot support regions is a general support region. The quantity of resilient material per unit volume in the general support region is greater than the quantity of resilient material per unit volume in the shoulder, tail and foot support regions. In accordance with a second embodiment of the present invention, the pad may be formed with only a tail support region extending laterally between the longitudinal sides thereof and surrounded by a general support area. The tail support region will have a quantity of resilient material per unit volume that is less than the quantity of resilient material per unit volume in the general support region.

36 Claims, 4 Drawing Sheets

INCLINED ANATOMIC SUPPORT SURFACE

FIELD OF THE INVENTION

The present invention relates generally to foam pads, and more particularly to a pad which Is adapted to support a recumbent human being upon an inclined surface, and includes distinct shoulder, tail and foot support regions for facilitating optimal anatomical conformance to the human body.

BACKGROUND OF THE INVENTION

A bed design which is gaining increased recognition in the bedding industry due to its therapeutic benefits is referred to as a "slant bed". The slant bed comprises a bed frame which has a ramped or sloped configuration, such that one end of the bed is elevated relative to the opposite end thereof. Due to the configuration of the bed frame, when a conventional mattress is positioned thereupon, the mattress defines an inclined support surface upon which the human body is rested. In this respect, a user may position himself or herself upon the support surface of the mattress such that the head is elevated relative to the feet or, alternatively, the feet are elevated relative to the head.

As previously indicated, the slant beds have been found to provide therapeutic benefits to the user resting thereupon. In this respect, it is well recognized that orienting the human body at a slight angle rather than horizontally has an effect on blood circulation, and in particular venous blood pressure within certain areas of the human body. These effects are attributable to the manner in which gravitational forces act upon the circulating blood when the human body is disposed in an inclined rather than a horizontal orientation. As such, by elevating the head or feet relative to the remainder of the body, blood circulation may be altered in a manner facilitating a desired therapeutic effect. It has been found that despite their therapeutic benefits, the primary deficiency of slant beds is the tendency of the user to slide or slip toward the non-elevated end of the bed in view of the user resting upon an inclined support surface. In this respect, the prior art mattresses which are positioned upon the slant bed frame are not adapted to maintain the user upon the inclined support surface defined thereby in a non-slip manner.

In addition to the foregoing, it has been documented in the bedding industry that when a human being assumes a supine or reclined position on a mattress or similar support surface, the pressure exerted on the human body is typically the highest beneath the shoulders (the scapulae) and the tail (the buttocks and trochanter). In this respect, since these particular areas of the body are often of the greatest mass and projection, the pressure exerted thereagainst by the support surface is maximized. Other areas of the body subject to substantial pressure include the ankles, heels, and portions of the feet. It has been determined that in these high-pressure areas, the pressure exerted against the body can be sufficient to occlude the capillaries and lymph vessels, thereby preventing the circulation of oxygen and nutrients to the skin. In addition, because airflow over these skin areas is typically prevented due to the intimate contact of the surface of the mattress or similar support surface thereagainst, greater amounts of moisture are excreted for the dissipation of heat and waste. As will be recognized, these types of occurrences facilitate discomfort and, in some instances, seriously degrade the quality of sleep.

In an effort to alleviate the problems associated with the exertion of high pressure on certain body areas of a supine or reclined human being, there has been developed in the prior art certain products including static air, water, and foam support pads which are adapted to be applied to existing mattresses. Although these particular types of pads are not adapted to reduce the overall resistance of the underlying mattress to the weight of the body, they are adapted to reduce the pressure level on the areas of highest pressure by redistributing the load and allowing a greater portion of the pad to support the body. However, each of these prior art support pads possesses certain deficiencies which detract from its overall utility.

Though static air and water support pads generally provide superior high-pressure reduction capabilities at the bony protuberances of the human body, they permit only limited airflow with heat dissipation. Additionally, both static air and water support pads require filling, and are susceptible to leaks. Further, such pads tend to "bottom out" by permitting the weight of the user to displace the air or water in the pad to the extent that the user is supported by the underlying mattress, rather than by the air or water cushion. Static water support pads are also undesirable in that they are heavy and unwieldy to transport. While pumps and valves can be used to vary the pressure resistance of the static air and water pads over time, these features render these pads both expensive and difficult to install and transport.

With regard to convoluted foam pads, such pads are generally relatively inexpensive and easily transported, while providing desirable airflow and moisture reduction capabilities. However, despite considerable design efforts, it is proved exceedingly difficult to develop an easily manufactured convoluted foam pad which is capable of providing pressure reduction characteristics comparable to static air and water support pads.

In view of the foregoing, there exists a need in the art for a support pad which may be applied to the inclined support surface defined by a mattress used in a slant bed for purposes of preventing any sliding or slippage of the user toward the non-elevated end of the bed. There also exists a need in the art for an anatomically conformable support pad which may be applied to an existing mattress and includes distinct shoulder, tail and foot support regions for providing improved support to the corresponding anatomical body portions in order to mitigate the effects of pressure-related discomfort.

The present invention addresses these particular needs in the prior art by providing an anatomically conforming support pad which is positionable upon an inclined surface for supporting a recumbent human being upon the inclined surface in a manner preventing slippage of the body thereupon. The support pad of the present invention includes distinct shoulder, tail and foot support regions which, in addition to providing improved anatomical support to the human body, also aid in maintaining the body in a desired orientation upon the support pad.

SUMMARY OF THE INVENTION

In accordance with a first embodiment of the present invention, there is provided a pad positionable upon an inclined surface for supporting a recumbent human being upon the inclined surface in a manner preventing slippage of the human being thereupon. The pad comprises a generally rectangular substrate formed of a resilient material. The substrate includes opposed lateral and longitudinal sides, a top surface, and a generally planar bottom surface. Formed within the top surface of the substrate are laterally extending shoulder, tail and foot support regions, all of which are surrounded by a general support region. The quantity of resilient material per unit volume in the general support region is greater than the quantity of resilient material per unit volume in the shoulder, tail and foot support regions.

In the first embodiment, the shoulder, tail and foot support regions are each formed by peaks arranged in rows, wherein each peak has a substantially flat top and is spaced from any adjacent peak in the same row by a valley. The flat tops of the peaks are disposed in substantially co-planar relation to each other and to the general support surface which has a substantially planar configuration. The general support region and the flat tops of the peaks collectively define the top surface of the substrate.

The preferred thickness of the substrate, i.e., the distance separating the top and bottom surfaces thereof from each other, is from 1 to 5 inches. Additionally, some of the peaks are preferably formed so as to define corners, with the corners of certain ones of the peaks being connected to each other by webbing. However, some of the corners are not connected to each other by webbing so as to provide an area of decreased resistance to pressure. The resilient material used to fabricate the support pad preferably comprises foam, and in particular polyurethane foam having a density of from 1 to 3 pounds per cubic foot.

The lateral sides of the substrate each have a width of from 25 to 40 inches, and a preferred width of approximately 35 inches. Additionally, the longitudinal sides of the substrate each have a length of from 60 to 90 inches, and a preferred length of approximately 72 inches. The shoulder, tail and foot support regions are each rectangularly configured, and include longitudinal edges which extend in generally parallel relation to the lateral sides of the substrate, and lateral edges which extend in generally parallel relation to the longitudinal sides of the substrate. The lateral edges of the shoulder and foot support regions each have a width of from 12 to 22 inches, and a preferred width of approximately 18 inches, with the lateral edges of the tail support region each having a width of from 9 to 17 inches, and a preferred width of approximately 11 inches. The distance separating the shoulder and foot support regions from respective ones of the lateral sides of the substrate disposed closest thereto is from 4 to 8 inches. Additionally, the distance separating the shoulder and foot support regions from the tail support region is from 8 to 12 inches, and preferably about 9 inches. In the preferred embodiment, the width of each of the lateral sides of the substrate exceeds the length of each of the longitudinal edges of the shoulder, tail and foot support regions, each of which are centrally positioned between the longitudinal sides of the substrate.

In accordance with a second embodiment of the present invention, there is provided a pad which is positionable upon an inclined surface for supporting a recumbent human being upon the inclined surface in a manner preventing slippage of the human being thereupon. The pad of the second embodiment is substantially similar to the pad previously described in relation to the first embodiment, but excludes the shoulder and foot support regions. In this respect, the pad constructed in accordance with the second embodiment includes only a laterally extending tail support region which is formed within the top surface of the substrate and is surrounded by a general support region. As in the first embodiment, the quantity of resilient material per unit volume in the general support region is greater than the quantity of resilient material per unit volume in the tail support region. The tail support region of the support pad constructed in accordance with the second embodiment is centrally positioned between the lateral and longitudinal sides of the substrate, and is also formed by peaks arranged in rows having flat tops which extend in generally co-planar relation to the substantially planar general support region.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENTS

Figure 1:
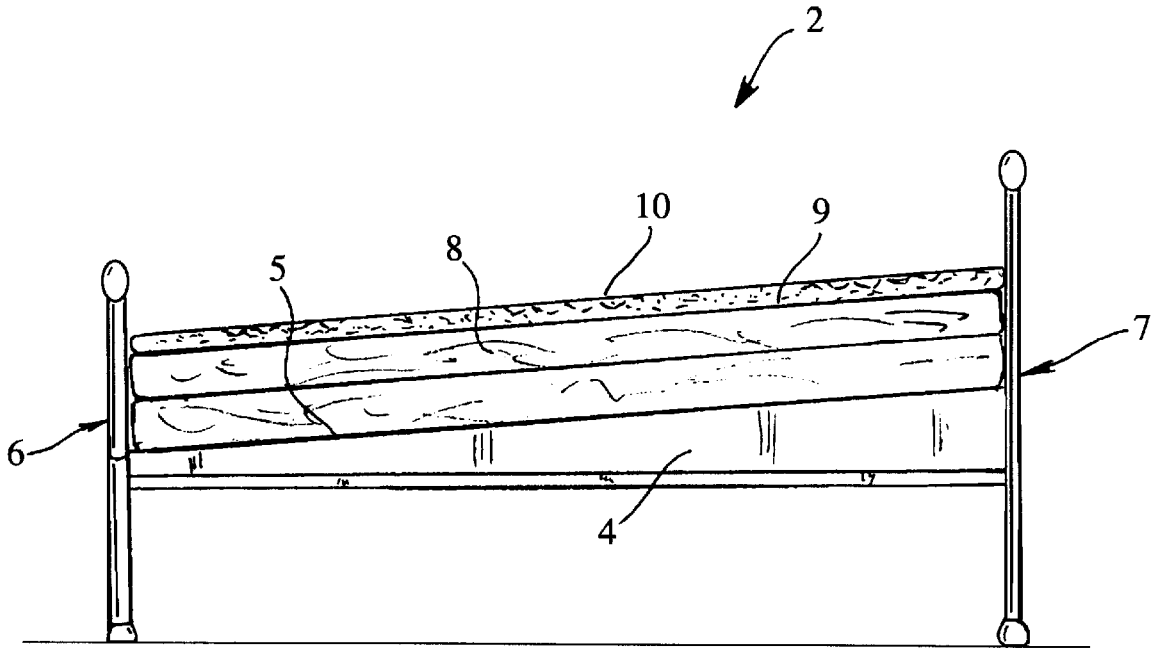
FIG. 1 is a side elevational view of an inclined support structure having the anatomically conforming support pad constructed in accordance with the present invention positioned thereupon.

Referring now to the drawings wherein the showings are for purposes of illustrating preferred embodiments of the present invention only, and not for purposes of limiting the same, FIG. 1 illustrates a slant bed 2 which is adapted to provide the previously described therapeutic benefits to a user resting thereupon. The slant bed 2 includes a bed frame 4 which defines an angled or sloped top surface 5. As such, the bed frame 4 includes a first, non-elevated end 6 and a second, elevated end 7, with the top surface 5 sloping downwardly from the second end 7 toward the first end 6. Positioned upon the top surface 5 of the slant bed 2 is a mattress 8. Due to the slanted configuration of the bed frame 4, the mattress 8 defines an upper inclined support surface 9 when positioned upon the bed frame 4.

As previously indicated, the user may rest upon the inclined surface 9 such that the head is elevated relative to the feet (i.e., the head is disposed closest to the second end 7), or the feet are elevated relative to the head (i.e., the head is disposed closest to the first end 6). As also previously explained, irrespective of how the user is oriented upon the inclined surface 9, there is a tendency for the body to slide or slip toward the non-elevated first end 6 of the support frame 4 due to the inclined orientation of the support surface 9. To alleviate this problem and to further provide anatomically conforming support to the user, applied to the inclined support surface 9 of the mattress 8 is the support pad 10 of the present invention, the structure of which will be discussed in more detail below.

Figure 2:
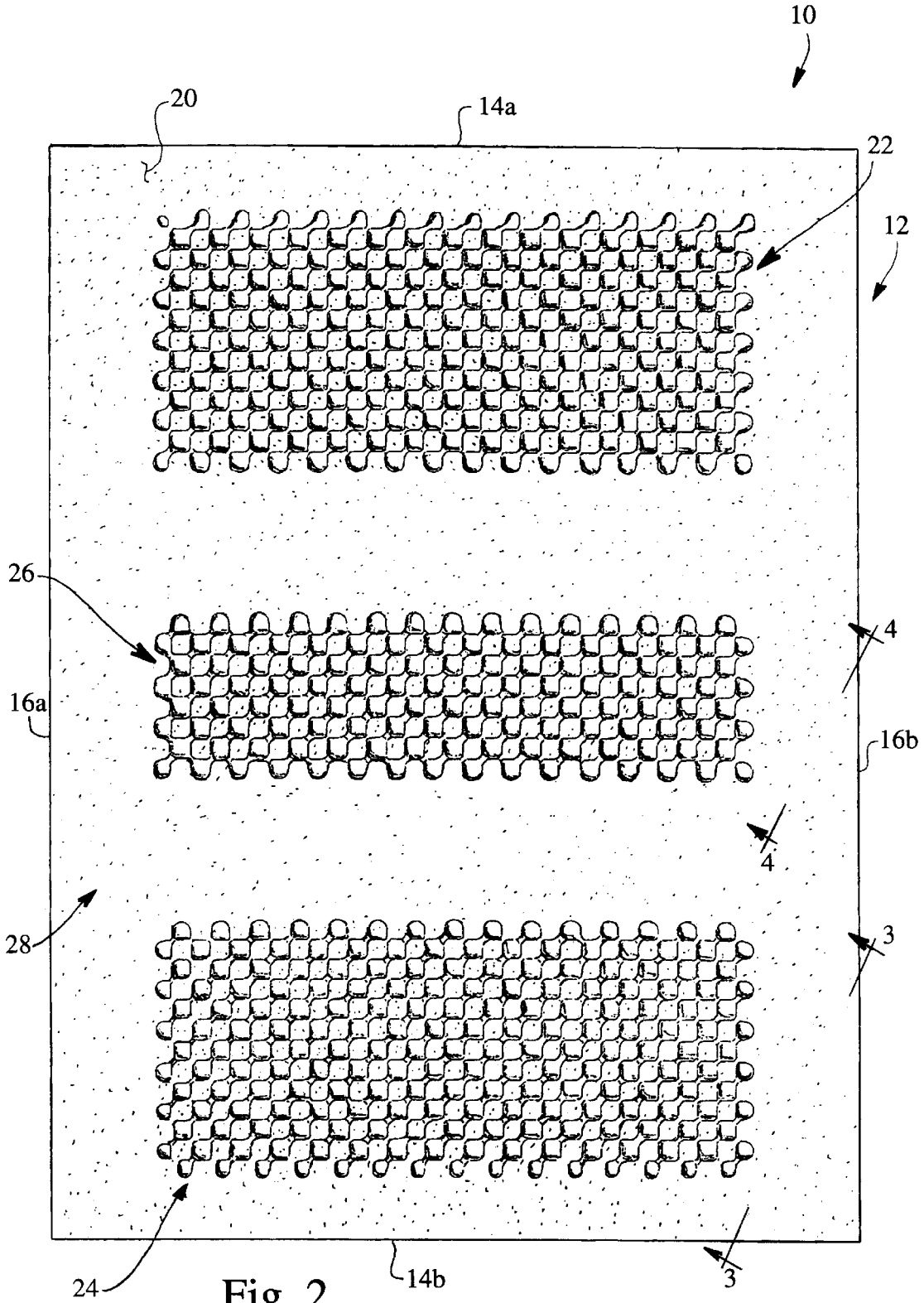
FIG. 2 is a top elevational view of the support pad as constructed in accordance with a first embodiment of the present invention.

FIG. 2 perspectively illustrates the anatomically conforming support pad 10 as constructed in accordance with a first embodiment of the present invention. The support pad 10 comprises a rectangularly configured substrate 12 which is formed of a resilient material. In the support pad 10, the resilient material preferably comprises foam. Though the support pad 10 of the present invention can be made from a wide variety of types of foam of varying density and thickness, it has been found that the desired combination of cushioning and support is obtained from an open cell expanded polyurethane foam having a density of from 1 to 3 pounds per cubic foot, and preferably about 1.5 pounds per cubic foot.

Figure 3:
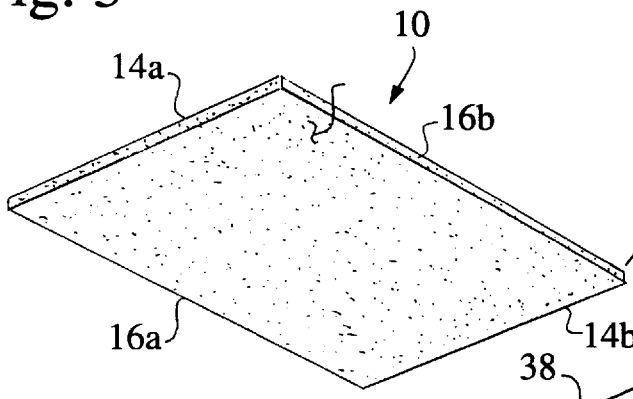
FIG. 3 is a bottom perspective view of the support pad shown in FIG. 2.

As seen in FIGS. 2 and 3, the rectangularly configured substrate 12 includes opposed lateral sides 14*a*, 14*b*, opposed longitudinal sides 16*a*, 16*b*, a generally planar bottom surface 18 and a top surface 20. When the support pad 10 is used in conjunction with the slant bed 2, the bottom surface 18 is rested directly upon the inclined support surface 9 defined by the mattress 8. In the first embodiment, the lateral sides 14*a*, 14*b* of the substrate 12 each have a width of from 25 to 40 inches, and a preferred width of approximately 35 inches. Additionally, the longitudinal sides 16*a*, 16*b* of the substrate 12 each have a length of from 60 to 90 inches, and a preferred length of approximately 72 inches. However, it will be recognized that the substrate 12 may be fabricated having length and width dimensions other than those previously described.

Formed within the top surface 20 of the substrate 12 is a laterally extending shoulder support region 22 which is disposed adjacent the lateral side 14*a*, a laterally extending foot support region 24 which is disposed adjacent the lateral side 14*b*, and a laterally extending tail support region 26 which is disposed intermediate the shoulder and foot support regions 22, 24. Surrounding the shoulder, foot and tail support regions 22, 24, 26 is a general support region 28 which, in the first embodiment, has a substantially planar configuration.

As seen in FIG. 2, the shoulder, foot and tail support regions 22, 24, 26 are each rectangularly configured and include longitudinal edges which extend in generally parallel relation to the lateral sides 14*a*, 14*b* of the substrate 12, and lateral edges which extend in generally parallel relation to the longitudinal sides 16*a*, 16*b* of the substrate 12. The lateral edges of the shoulder and foot support regions 22, 24 each have a width of from 12 to 22 inches, and a preferred width of approximately 18 inches. Additionally, the lateral edges of the tail support region 26 each have a width of from 9 to 17 inches, and a preferred width of approximately 11 inches. The distance separating the shoulder and foot support regions 22, 24 from the respective ones of the lateral sides 14*a*, 14*b* disposed closest thereto is preferably from 4 to 8 inches. The distance separating the shoulder and foot support regions 22, 24 from the tail support region 26 is from 8 to 12 inches, and preferably about 9 inches. Though the tail support region 26 may be disposed closer to either the shoulder support region 22 or the foot support region 24, it is preferably centrally positioned therebetween.

As previously indicated, the widths of the lateral edges of the shoulder and foot support regions 22, 24 are preferably equal to each other, and exceed the widths of the lateral edges of the tail support region 26. However, as further seen in FIG. 2, the lengths of the longitudinal edges of the shoulder, foot and tail support regions 22, 24, 26 are preferably equal to each other. Additionally, the width of each of the lateral sides 14*a*, 14*b* of the substrate 12 preferably exceeds the length of each of the longitudinal edges of the shoulder, foot and tail support regions 22, 24, 26. In this respect, the shoulder, foot and tail support regions 22, 24, 26 are each centrally positioned between the longitudinal sides 16*a*, 16*b* of the substrate 12.

Referring now to FIGS. 2 and 4–7, in the support pad 10, the quantity of resilient material or polyurethane foam per unit volume in the general support region 28 of the substrate 12 is greater than the quantity of resilient polyurethane foam per unit volume in the shoulder, foot and tail support regions 22, 24, 26. This differential is achieved by extracting foam from the shoulder, foot and tail support regions 22, 24, 26 in accordance with the methodology described in Applicant's U.S. Pat. No. 5,010,609 issued Apr. 30, 1991, the disclosure of which is incorporated herein by reference.

Figure 5:
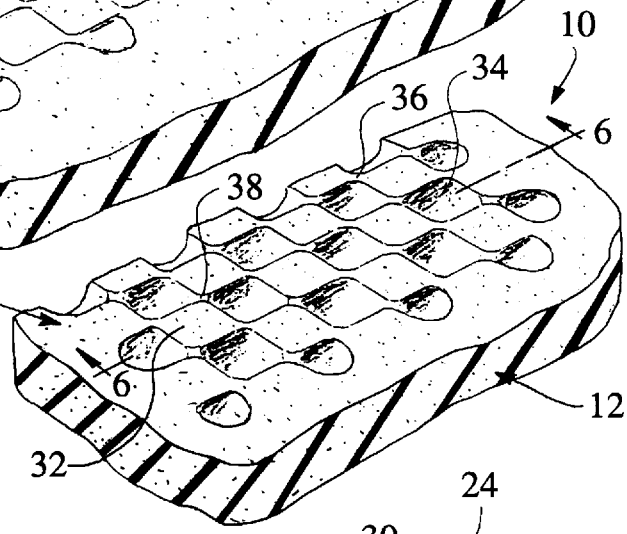
FIG. 5 is a partial perspective view taken along line 4—4 of FIG. 2.
Figure 6:
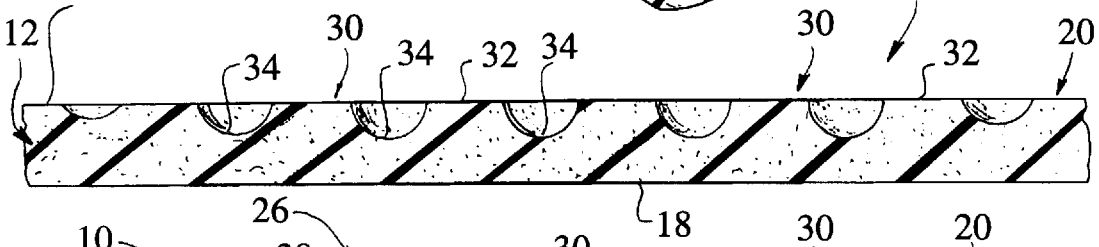
FIG. 6 is a cross-sectional view taken along line 5—5 of FIG. 4.

In the support pad 10, the shoulder, foot and tail support regions 22, 24, 26 are each formed by peaks 30 arranged in rows, with each peak 30 having a substantially flat top 32 and being spaced from any adjacent peak 30 in the same row by a generally concave valley 34. As best seen in FIGS. 5 and 6, the flat tops 32 of the peaks 30 are disposed in substantially co-planar relation to each other and to the planar general support region 28 of the substrate 12. In this respect, the flat tops 32 and general support region 28 cumulatively define the top surface 20 of the substrate 12.

The thickness of the support pad 10, and in particular the distance separating the top surface 20 (and hence the flat tops 32 and general support region 28) from the bottom surface 18 is from 1 to 5 inches, and is preferably about 3 inches. Additionally, the depth of each of the valleys 34 (i.e., the distance separating the apex of each valley 34 from the flat tops 32 of the surrounding peaks 30) is preferably about 1½ inches, with the valley thickness (i.e., the distance separating the apex of each valley 34 from the bottom surface 18) thus also being about 1½ inches.

In the support pad 10, the density of each of the shoulder, foot and tail support regions 22, 24, 26 may be increased by extracting less foam material therefrom (thus resulting in a decreased valley depth and increased valley thickness), or may be decreased by extracting additional quantities of foam material therefrom (thus resulting in an increased valley depth and a decreased valley thickness). As will be recognized, the lesser the density of a particular support region of the support pad 10, the greater the amount of pressure relief provided thereby. Though the densities of the shoulder, foot and tail support regions 22, 24, 26 may be varied as desired, the valley depths and hence the valley thicknesses are always sufficient to ensure that the human body supported by the support pad 10 does not "bottom out". For a support pad 10 formed of a polyurethane foam material having a density of from 1 to 3 pounds per cubic foot, a total support pad thickness of from about 3 to 5 inches is optimal, with a valley thickness of approximately 1½ inches being sufficient to prevent bottoming out in most instances.

Figure 7:
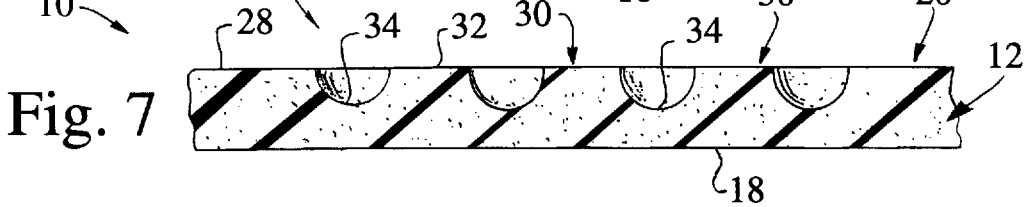
FIG. 7 is a cross-sectional view taken along line 6—6 of FIG. 5.

As further seen in FIGS. 6 and 7, the tail support region 26 of the support pad 10 is preferably slightly less dense than the shoulder and foot support regions 22, 24 which are of identical density (and hence valley depth and thickness). The decreased density of the tail support region 26 is facilitated by extracting additional foam material therefrom, thus resulting in a valley depth which is slightly greater than that of the shoulder and foot support regions 22, 24, and a valley thickness which is slightly less than that of the shoulder and foot support regions 22, 24. However, it will be recognized that the densities of the shoulder, foot and tail support regions 22, 24, 26 may all be equal, or may differ from each other according to the desired anatomical. conformance attributes of the support pad 10.

Figure 4:
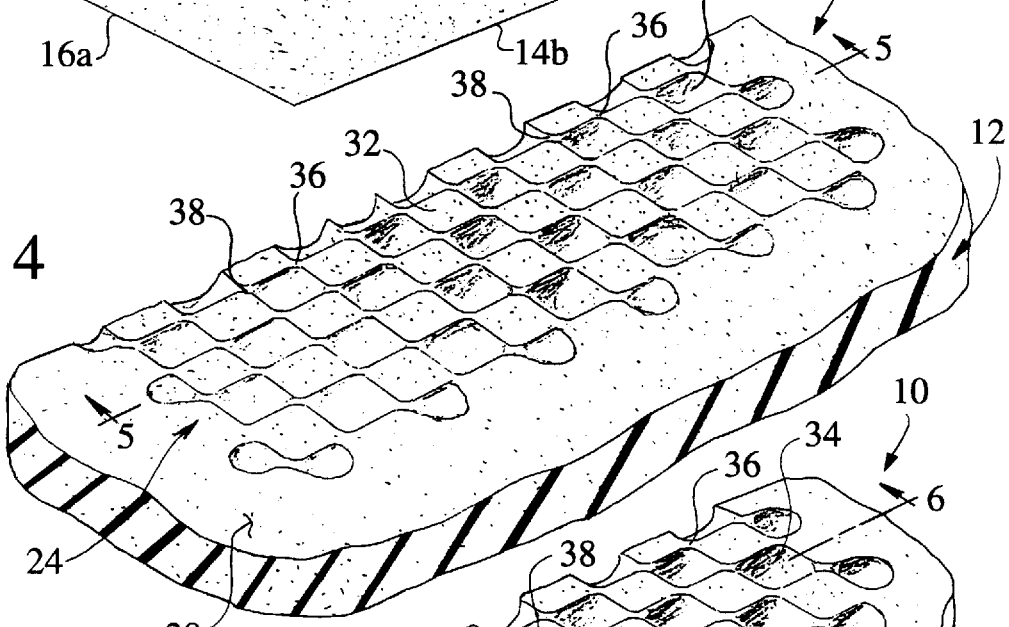
FIG. 4 is a partial perspective view taken along line 3—3 of FIG. 2.

As best seen in FIGS. 2, 4 and 5, each of the peaks 30 preferably has a generally square cross-sectional configuration and defines four (4) corner regions. In the preferred embodiment, the corner regions of certain ones of the peaks 30 are integrally connected to the corner regions of other peaks 30 by webbing 36. Though some of the corner regions are connected to each other via the webbing 36, other corner regions are not connected to each other, thus defining voids 38 which extend between respective pairs of valleys 34. The voids 38 are adapted to provide areas of decreased resistance to pressure. As further seen in FIGS. 2, 4 and 7, the webbing 36 and voids 38 included between the peaks 30 of the shoulder, foot and tail support regions 22, 24, 26 are generally arranged in diagonally extending patterns therewithin.

Due to the decreased foam material per unit volume in the shoulder, foot and tail support regions 22, 24, 26 of the support pad 10, the corresponding areas of the human body applied to these regions are subjected to significantly less pressure when the user assumes a supine or reclined position upon the support pad 10. Additionally, due to the manner in which the general support region 28 of greater density (i.e., having a greater quantity of foam material per unit volume) surrounds the shoulder, foot and tail support regions 22, 24, 26, greater support is provided to the lower back and thighs of the supine or reclined user. Indeed, those areas of the human body positioned upon the shoulder, foot and tail support regions 22, 24, 26 of the support pad 10 will "sink" thereinto to a greater degree than those areas positioned upon the general support region 28. As will be recognized, the anatomical conformance provided by the shoulder, foot, tail and general support regions 22, 24, 26, 28 cumulatively facilitates optimal comfort to the human body resting upon the support pad 10. Additionally, such conformance prevents the user from sliding or slipping downwardly toward the non-elevated first end 6 of the bed frame 4.

Advantageously, the support pad 10 is easily placable upon the inclined support surface 9 defined by the mattress 8 to provide enhanced user comfort and sleep quality. In the event that the user's head is to be elevated relative to the remainder of the body, the support pad 10 is placed upon the inclined support surface 9 of the mattress 8 such that the shoulder support region 22 thereof is disposed closest to the second end 7 of the bed frame 4. Conversely, if the user's feet are to be elevated relative to the remainder of the body, the foot support region 24 of the support pad 10 is disposed closest to the second end 7 of the bed frame 4. Additionally, it will be recognized by those of ordinary skill in the art that the support pad 10 may also be placed upon the horizontally oriented mattress of a conventional bed for providing increased user comfort and sleep quality.

Figure 8:
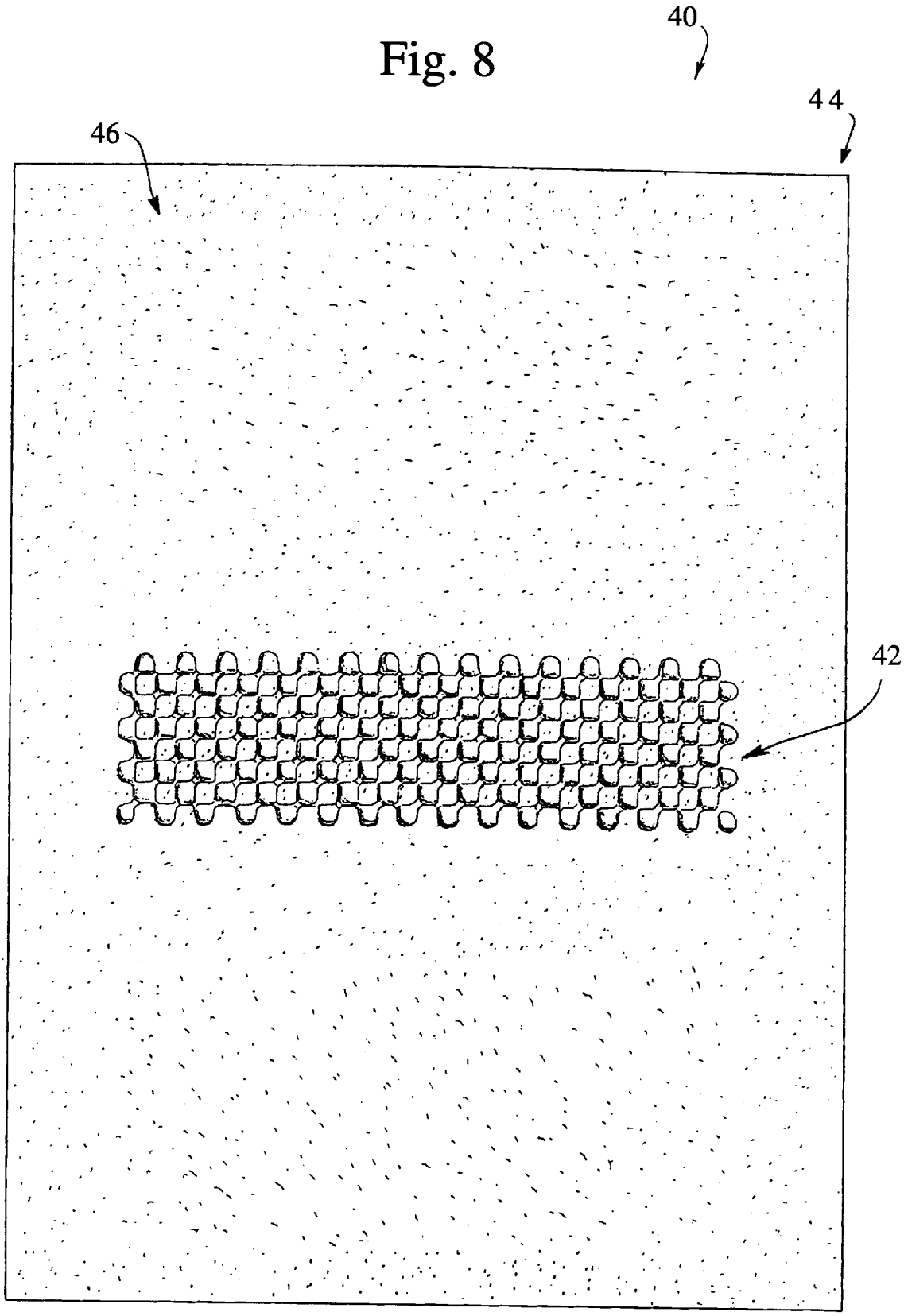
FIG. 8 is a top plan view of the support pad as constructed in accordance with a second embodiment of the present invention.

Referring now to FIG. 8, there is illustrated an anatomically conforming support pad 40 constructed in accordance with a second embodiment of the present invention. The support pad 40 is identical to the support pad 10 of the first embodiment in all respects, but does not include shoulder and foot support regions. In this respect, the support pad 40 includes only a tail support region 42 which is sized and configured identically to the tail support region 26, and is centrally positioned between the opposed lateral and longitudinal sides of the substrate 44 of the support pad 40.

In the support pad 40, the tail support region 42 causes less pressure to be applied to the buttocks and trochanter of a human being which, as previously indicated, is often the area of the human body of greatest mass and projection. Though not shown, it will be recognized that the general support region 46 of the substrate 44 which surrounds the tail support region 42 and has a generally planar configuration may, in its entirety, be slightly extracted, so long as the density (i.e., the quantity of foam material per unit volume thereof) is greater than that of the tail support region 42.

Additional modifications and improvements of the present invention may also be apparent to those skilled in the art. Thus, the particular combination of parts described and illustrated herein is intended to represent only certain embodiments of the present invention, and is not intended to serve as limitations of alternative devices within the spirit and scope of the invention.

What is claimed is:

1. A pad positionable upon an inclined surface for supporting a recumbent human being upon the inclined surface in a manner preventing slippage of the human being thereupon, said pad comprising:

a generally rectangular substrate formed of a resilient material and having opposed lateral and longitudinal sides, a top surface, and a generally planar bottom surface;

a laterally extending shoulder support region formed within the top surface and being of a first density;

a laterally extending tail support region formed within the top surface and being of a second density which is less than the first density;

a laterally extending foot support region formed within the top surface and being of a third density which exceeds the second density; and a general support region extending between said shoulder, tail and foot support regions and being of a fourth density which exceeds the first, second, and third densities.

2. The pad of claim 1 wherein the general support region surrounds the shoulder, tail and foot support regions.

3. The pad of claim 2 wherein said shoulder, tail and foot support regions are each formed by peaks arranged in rows, wherein each peak has a substantially flat top and is spaced from any adjacent peak in the same row by a valley.

4. The pad of claim 3 wherein the flat tops of the peaks are disposed in substantially co-planar relation to each other.

5. The pad of claim 4 wherein the general support region has a substantially planar configuration and is disposed in generally co-planar relation to the flat tops of the peaks, the general support region and the flat tops collectively defining the top surface of the substrate.

6. The pad of claim 5 wherein the distance separating the top and bottom surfaces of the substrate is from 1 to 5 inches.

7. The pad of claim 5 wherein certain ones of the peaks define corners, and the corners of certain ones of the peaks are connected to each other by webbing.

8. The pad of claim 7 wherein certain ones of the corners are not connected to each other by the webbing, thereby providing an area of decreased resistance to pressure.

9. The pad of claim 1 wherein said resilient material comprises foam.

10. The pad of claim 9 wherein said foam comprises polyurethane foam having a density of from 1 to 3 pounds per cubic foot.

11. The pad of claim 1 wherein:

the lateral sides of the substrate each have a width of from 25 to 40 inches; and the longitudinal sides of the substrate each have a length of from 60 to 90 inches.

12. The pad of claim 11 wherein:

the lateral sides of the substrate each have a width of approximately 35 inches; and the longitudinal sides of the substrate each have a length of approximately 72 inches.

13. The pad of claim 1 wherein the shoulder, tail and foot support regions are each rectangularly configured and include longitudinal edges which extend in generally parallel relation to the lateral sides of the substrate, and lateral edges which extend in generally parallel reaction to the longitudinal sides of the substrate.

14. The pad of claim 13 wherein:

the lateral edges of the shoulder support region each have a width of from 12 to 22 inches;

the lateral edges of the tail support region each have a width of from 9 to 17 inches; and the lateral edges of the foot support region each have a width of from 12 to 22 inches.

15. The pad of claim 14 wherein:

the lateral edges of the shoulder support region each have a width of approximately 18 inches;

the lateral edges of the tail support region each have a width of approximately 11 inches; and the lateral edges of the foot support region each have a width of approximately 18 inches.

16. The pad of claim 14 wherein the distance separating the shoulder support region from the lateral side of the substrate disposed closest thereto is from 4 to 8 inches, and the distance separating the foot support region from the lateral side of the substrate disposed closest thereto is from 4 to 8 inches.

17. The pad of claim 14 wherein the distance separating the shoulder and foot support regions from the tail support region is from 8 to 12 inches.

18. The pad of claim 17 wherein the distance separating the shoulder and foot support regions from the tail support region is approximately 9 inches.

19. The pad of claim 13 wherein the width of each of the lateral sides of the substrate exceeds the length of each of the longitudinal edges of the shoulder, tail and foot support regions which are each centrally positioned between the longitudinal sides of the substrate.

20. The pad of claim 1 wherein the third density is substantially equal to the first density.

21. A pad positionable upon an inclined surface for supporting a recumbent human being upon the inclined surface in a manner preventing slippage of the human being thereupon, said pad comprising:

a generally rectangular substrate formed of a resilient material and having opposed lateral and longitudinal sides, a top surface, and a generally planar bottom surface;

a laterally extending tail support region formed within the top surface by peaks arranged in rows, wherein each peak has a substantially flat top and is spaced from any adjacent peak in the same row by a valley; and a general support region extending between the tail support region and the lateral sides of the substrate, the general support region having a substantially planar configuration;

wherein the quantity of resilient material per unit volume in the general support region is greater than the quantity of resilient material per unit volume in the tail support region.

22. The pad of claim 21 wherein the general support region surrounds the tail support region.

23. The pad of claim 21 wherein the flat tops of the peaks are disposed in substantially co-planar relation to each other.

24. The pad of claim 23 wherein the general support region is disposed in generally co-planar relation to the flat tops of the peaks, the general support region and the flat tops collectively defining the top surface of the substrate.

25. The pad of claim 24 wherein the distance separating the top and bottom surfaces of the substrate is from 1 to 5 inches.

26. The pad of claim 24 wherein certain ones of the peaks define corners, and the corners of certain ones of the peaks are connected to each other by webbing.

27. The pad of claim 26 wherein certain ones of the corners are not connected to each other by the webbing, thereby providing an area of decreased resistance to pressure.

28. The pad of claim 20 wherein said resilient material comprises foam.

29. The pad of claim 28 wherein said foam comprises polyurethane foam having a density of from 1 to 3 pounds per cubic foot.

30. The pad of claim 20 wherein:

the lateral sides of the substrate each have a width of from 25 to 40 inches; and the longitudinal sides of the substrate each have a length of from 60 to 90 inches.

31. The pad of claim 30 wherein:

the lateral sides of the substrate each have a width of approximately 35 inches; and the longitudinal sides of the substrate each have a length of approximately 72 inches.

32. The pad of claim 20 wherein the tail support region is rectangularly configured and includes longitudinal edges which extend in generally parallel relation to the lateral sides of the substrate, and lateral edges which extend in generally parallel relation to the longitudinal sides of the substrate.

33. The pad of claim 32 wherein the lateral edges of the tail support region each have a width of from 9 to 17 inches.

34. The pad of claim 33 wherein the lateral edges of the tail support region each have a width of approximately 11 inches.

35. The pad of claim 32 wherein the tail support region is centrally positioned between the lateral sides of the substrate.

36. The pad of claim 32 wherein the width of each of the lateral sides of the substrate exceeds the length of each of the longitudinal edges of the tail support region which is centrally positioned between the longitudinal sides of the substrate.

* * * * *